US010253475B2

(12) United States Patent
Zhu et al.

(10) Patent No.: US 10,253,475 B2
(45) Date of Patent: Apr. 9, 2019

(54) CONSTRUCTION DEVICE AND METHOD FOR OFFSHORE WIND TURBINE FOUNDATION WITH PILING PERFORMED LATER

(71) Applicants: Ming Yang Smart Energy Group., Ltd., Zhongshan, Guangdong (CN); Zhejiang Hua Yun Offshore Engineering & Technology Service Co., Ltd., Hangzhou, Zhejiang (CN)

(72) Inventors: Ronghua Zhu, Zhongshan (CN); Zhenya Tian, Zhongshan (CN)

(73) Assignees: Ming Yang Smart Energy Group., Ltd., Guangdong (CN); Zhejiang Hua Yun Offshore Engineering & Technology Service Co., Ltd., Zhejiang (CN)

( * ) Notice: Subject to any disclaimer, the term of this patent is extended or adjusted under 35 U.S.C. 154(b) by 0 days.

(21) Appl. No.: 15/750,277

(22) PCT Filed: Jul. 18, 2016

(86) PCT No.: PCT/CN2016/090331
§ 371 (c)(1),
(2) Date: Feb. 5, 2018

(87) PCT Pub. No.: WO2017/020697
PCT Pub. Date: Feb. 9, 2017

(65) Prior Publication Data

US 2018/0223497 A1 Aug. 9, 2018

(30) Foreign Application Priority Data

Aug. 3, 2015 (CN) ..... 2015 1 0481801

(51) Int. Cl.
*E02D 27/42* (2006.01)
*E21B 41/08* (2006.01)
(Continued)

(52) U.S. Cl.
CPC ..... *E02D 27/425* (2013.01); *E02D 5/28* (2013.01); *E02D 5/60* (2013.01); *E02D 27/42* (2013.01)

(58) Field of Classification Search
CPC ..... B63B 21/24; B63B 21/26; B63B 21/50; E02B 17/00; E02B 17/02; E02B 17/027;
(Continued)

(56) References Cited

U.S. PATENT DOCUMENTS 1,718,006 A * 6/1929 Reno ..... B63B 35/50 114/261
2,997,852 A * 8/1961 Suderow ..... E02B 17/021 114/265
(Continued)

FOREIGN PATENT DOCUMENTS

CN 102587405 7/2012
CN 202767094 3/2013
(Continued)

OTHER PUBLICATIONS

Search Report PCT/ISA/220, PI1650556GZ, dated Oct. 17, 2016, 11 pages.
(Continued)

*Primary Examiner* — Benjamin D Fiorello
*Assistant Examiner* — Edwin J Toledo-Duran
(74) *Attorney, Agent, or Firm* — Butzel Long, P.C.; Gunther J. Evanina

(57) ABSTRACT

A construction device for an offshore wind turbine foundation with piling performed later. The construction device comprises an offshore wind turbine foundation (1), a pile
(Continued)

casing (2) and a sleeve (3). The pile casing (2) is used for the installation of a steel pile (4) and arranged at the bottom of the offshore wind turbine foundation (1). The lower end of the sleeve (3) is detachably connected with the upper end of the pile casing (2). A construction method for an offshore wind turbine foundation with piling performed later is also provided.

11 Claims, 3 Drawing Sheets

(51) Int. Cl.
*E02D 5/28* (2006.01)
*E02D 5/60* (2006.01)

(58) Field of Classification Search
CPC ..... E02B 2017/006; E02D 5/54; E02D 7/00; E02D 7/02; E02D 11/00; E02D 13/04; E02D 23/00; E02D 27/525; E21B 41/08
USPC ..... 405/195.1, 196, 197, 198, 199, 223.1, 405/224, 224.1, 227, 228, 231, 232, 244, 405/249, 250, 251; 114/258, 259, 260, 114/261, 262, 263, 264, 265, 266, 267
See application file for complete search history.

(56) References Cited

U.S. PATENT DOCUMENTS 3,029,608 A * 4/1962 Perkins ..... E02B 17/00 405/208
3,326,006 A * 6/1967 Mount ..... E02D 5/52 285/381.1
3,457,728 A * 7/1969 Pogonowski ..... E02B 17/0008 405/227
3,646,947 A * 3/1972 Rochelle ..... E02B 17/00 134/167 C
3,851,483 A * 12/1974 Holley, Jr. ..... E02D 5/28 405/232
3,922,869 A * 12/1975 Wisotsky ..... E02D 7/00 405/228
3,991,581 A * 11/1976 Kolb ..... E02B 17/027 405/227
4,212,562 A * 7/1980 Stone ..... E21B 33/035 166/366
4,405,115 A * 9/1983 Boyadjieff ..... E02B 17/0854 254/106
4,589,802 A * 5/1986 Hampton ..... E21B 7/128 405/224
4,687,062 A * 8/1987 Beghetto ..... E21B 41/08 166/366
4,740,110 A * 4/1988 Saffrhan ..... E21B 41/04 405/191
5,074,716 A * 12/1991 Hollowell ..... E02B 17/0008 405/224
5,385,432 A * 1/1995 Kiyomiya ..... E02B 3/06 405/204
5,755,533 A * 5/1998 Snyder, Jr. ..... B63B 21/502 166/338
6,299,385 B1 * 10/2001 Barnes ..... E02B 17/021 405/195.1
6,494,644 B1 * 12/2002 Scandaliato ..... E02D 5/26 403/300
7,416,367 B2 * 8/2008 Onge ..... E02D 5/74 405/229
9,181,674 B2 * 11/2015 El Naggar ..... E02D 7/22
2004/0091322 A1 * 5/2004 May ..... E02D 35/00 405/244
2008/0226398 A1 * 9/2008 Gibberd ..... E02D 5/40 405/223
2012/0014753 A1 * 1/2012 Jung ..... E02D 13/00 405/227
2012/0107055 A1 * 5/2012 Baumfalk ..... E02B 17/0004 405/228
2012/0213593 A1 * 8/2012 Vandenbulcke ..... E02D 13/04 405/227
2012/0213594 A1 * 8/2012 Vandenbulcke ..... E02D 13/04 405/228
2012/0328374 A1 * 12/2012 El Naggar ..... E02D 7/22 405/233
2013/0220203 A1 * 8/2013 Bollmohr ..... E02B 17/021 114/265
2013/0266453 A1 * 10/2013 Moiret ..... E02B 17/021 416/244 R
2015/0023738 A1 * 1/2015 Van Vessem ..... E02D 13/04 405/228
2015/0110564 A1 * 4/2015 West ..... E02D 3/10 405/227
2015/0337517 A1 * 11/2015 Hall ..... E02B 17/02 405/227
2016/0060838 A1 * 3/2016 El Naggar ..... E02D 7/22 405/241

FOREIGN PATENT DOCUMENTS

CN 105155569 12/2015
CN 204825955 12/2015
FR 2536826 6/1986

OTHER PUBLICATIONS

Translation CN Office Action, Application No. or Publication No. 201510481801.9, 6 pages.
Patent Abstract for FR2536826, date of publication: Jun. 20, 1986, 1 page.
Patent Abstract for CN102587405, date of publication: Jul. 18, 2012, 1 page.
Patent Abstract for CN105155569, date of publication: Dec. 16, 2015, 1 page.
Patent Abstract for CN202767094, date of publication: Mar. 6, 2013, 1 page.
Patent Abstract for CN204825955, date of publication: Dec. 2, 2015, 1 page.

* cited by examiner

CONSTRUCTION DEVICE AND METHOD FOR OFFSHORE WIND TURBINE FOUNDATION WITH PILING PERFORMED LATER

CROSS-REFERENCE TO RELATED APPLICATIONS

This application claims priority to International Patent Application No. PCT/CN2016/090331 filed on Jul. 18, 2016, and Chinese Patent Application No. 201510481801.9 filed on Aug. 3, 2015, the entire contents of which are incorporated herein by reference.

TECHNICAL FIELD

The present disclosure relates to the technical field of offshore wind turbine foundation construction, and particularly to a construction device and a construction method for offshore wind turbine foundation with piling performed later.

So far, there are two methods for constructing an offshore wind turbine foundation, i.e. with piling performed beforehand and piling performed afterwards. The method, in which piling is performed beforehand, normally comprises driving steel pipe piles into the seabed first, pitching the pile legs of an offshore wind turbine foundation into the steel piles, and then performing grouting connection. The construction method for an offshore wind turbine foundation with piling performed afterwards is a traditional method for constructing an offshore wind turbine foundation. In such method, several pile casings for pitching piles are provided at the bottom of the offshore wind turbine foundation. For such offshore wind turbine foundation with pile casings, the traditional construction method comprises placing the offshore wind turbine foundation at the seabed first, pitching steel piles from the pile casings to a design depth, and then performing leveling and grouting underwater. In such method, underwater robots or divers are required to perform leveling and grouting underwater, which is difficult and is even more difficult especially in most sea areas in China with thick sludge and muddy seabed. Besides, for rock seabed, it is very difficult to embed piles into rocks by such traditional construction method, and highly sophisticated equipment is required.

SUMMARY OF THE INVENTION

The present disclosure provides a construction device for offshore wind turbine foundation with piling performed later (i.e. device for constructing an offshore wind turbine foundation with piling performed afterwards), which is intended to overcome the above problems to eliminate the need of leveling and grouting underwater.

The present disclosure is realized in the following way.

A device for constructing an offshore wind turbine foundation with piling performed afterwards includes an offshore wind turbine foundation, pile casings and sleeves. The pile casings are each configured to install a steel pile and provided at the bottom of the offshore wind turbine foundation. The lower end of each sleeve is detachably connected with the upper end of one pile casing.

Further, the pile casing includes a vertical pipe at the grouting segment of the pile casing, a platform inside the pile casing and an upper-end casing of the pile casing. The lower end of the upper-end casing of the pile casing is connected with the upper end of the vertical pipe at the grouting segment of the pile casing through the platform inside the pile casing. The upper end of the upper-end casing of the pile casing is detachably connected with the lower end of the sleeve. The platform inside the pile casing is provided for facilitating grouting connection in dry construction.

Further, leveling devices for leveling the offshore wind turbine foundation are also included. The leveling devices are provided within the pile casings.

The leveling devices each include a jack and a leveling supporting plate. The leveling supporting plate is provided at the top of the steel pile. The jack is provided between the leveling supporting plate and the platform inside the pile casing.

By providing the leveling device, it is convenient for construction persons to perform leveling in dry construction and ensures that leveling of the offshore wind turbine foundation requires no underwater operation by persons, which is safe and reliable.

Further, the upper portion of the pile casing is connected with the offshore wind turbine foundation by a bottom connecting plate. The lower portion of the pile casing is connected with the offshore wind turbine foundation by a transverse connecting plate. The outer sidewall of the pile casing is connected with the offshore wind turbine foundation by a vertical connecting plate.

With the bottom connecting plate, the transverse connecting plate and the vertical connecting plate, the pile casing can be fixedly connected with the offshore wind turbine foundation very steadily.

Further, the lower end of the pile casing is flush with the bottom connecting plate or protrudes from the bottom connecting plate. The lower end of the pile casing is flush with the bottom connecting plate or protrudes from the bottom connecting plate, wherein the protruded portion can be placed on the seabed or inserted into the sand layer of the seabed, so as to improve the sealing performance between the pile casing and the sleeve.

Further, the sleeve is provided with a temporary platform at its upper end. The temporary platform is connected with the offshore wind turbine foundation.

The temporary platform serves as both a pedestrian passage between a platform of the offshore wind turbine foundation and the sleeve, and a supporting structure for stabilizing the sleeve. And it can be used as a platform for placing devices for embedding piles into rocks or other construction devices.

The present disclosure also provides a construction method for offshore wind turbine foundation with piling performed later (a method for constructing an offshore wind turbine foundation with piling performed afterwards), to overcome the above problems.

The method is applicable to any one of the above devices for constructing an offshore wind turbine foundation with piling performed afterwards. The method includes: connecting the sleeves to the upper ends of the pile casings before hoisting the offshore wind turbine foundation; placing the offshore wind turbine foundation on the seabed in such a manner that the steel pipes at the bottoms of the pile casings are placed on the seabed or inserted into soil of the seabed; placing each steel pile inside one pile casing, and driving the steel pile by using a pile hammer to a specified design elevation within the pile casing; drawing out seawater and silt within the sleeves and the pile casings after the pile-driving process is completed; leveling the offshore wind turbine foundation; connecting the pile casings with the steel piles on site by welding and grouting which can be performed separately or simultaneously; and removing the sleeves.

Further, the method further includes a leveling method for leveling the offshore wind turbine foundation. The leveling method is applicable to a leveling device. The leveling device includes a jack and a leveling supporting plate. The leveling supporting plate is provided at the top of the steel pile. The pile casing is provided therein with the platform inside the pile casing. The jack is provided between the leveling supporting plate and the platform inside the pile casing.

The leveling method includes: the construction person going down from the sleeve to the platform inside the pile casing; the construction person placing the jack between the leveling supporting plate and the platform inside the pile casing; and the jack abutting against the leveling supporting plate to jack up the steel pile so that the offshore wind turbine foundation is pressed down, thus leveling the offshore wind turbine foundation.

It is convenient for the construction persons to perform leveling in dry construction and ensures that leveling of the offshore wind turbine foundation requires no underwater operations by persons, which is safe and reliable.

The present disclosure provides the following beneficial effects. In use, the device for constructing an offshore wind turbine foundation with piling performed afterwards obtained by the present disclosure through the above design is implemented by first hoisting the sleeves to the pile casings of the offshore wind turbine foundation and connecting the sleeves with the pile casings, placing the offshore wind turbine foundation with the sleeves at the seabed in such a manner that the steel pipes at the lower ends of the pile casings are placed on the seabed or inserted into the soil of the seabed, placing each steel pile inside one pile casing, driving the steel pile by using a pile hammer to the specified design elevation within the pile casing, drawing out the seawater and silt, leveling the offshore wind turbine foundation, connecting the pile casing and the steel pile by welding and grouting which can be performed separately or simultaneously, and then removing the sleeves, thus completing the construction.

The construction device and the construction method for an offshore wind turbine foundation with piling performed afterwards provided by the present disclosure, by adding sleeves for temporary work, ensure that leveling of the offshore wind turbine foundation and connecting operation of the steel piles with the offshore wind turbine foundation requires no underwater operations of persons, i.e. the dry construction is used throughout the process, which is safe and reliable. By changing from wet construction to dry construction, the construction persons are allowed to perform monitoring in real time on the platform of the pile casing and the construction accuracy is easy to control. Moreover, it is easy to embed piles into rocks in dry construction.

BRIEF DESCRIPTION OF THE DRAWINGS

In order to more clearly illustrate the technical solutions provided in the embodiments of the present disclosure, drawings necessary for the embodiments will be briefly described below. It should be understood that the following drawings merely show some embodiments of the disclosure and thus should not be construed as limiting the scope. Other related drawings can be obtained by those ordinarily skilled in the art according to these drawings without using any creative efforts.

Figure 1:
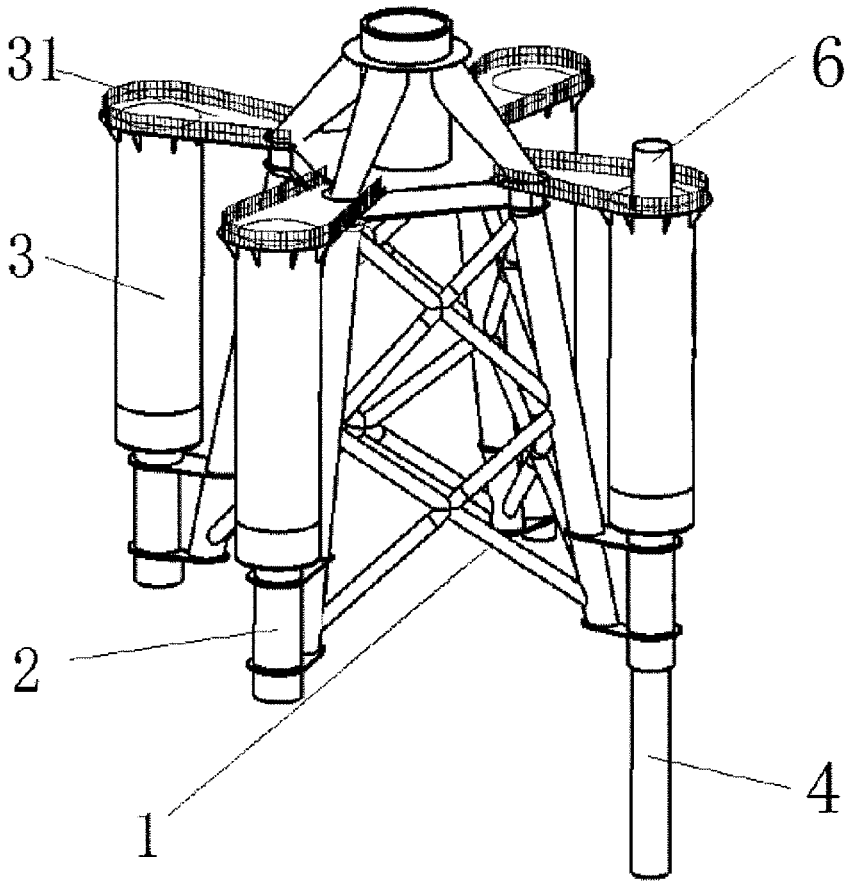
FIG. 1 is a structural schematic diagram of a device for constructing an offshore wind turbine foundation with piling performed afterwards provided by Embodiment 1 of the present disclosure.

Reference signs from the figures: offshore wind turbine foundation 1; pile casing 2; bottom connecting plate 21; vertical connecting plate 22; transverse connecting plate 23; vertical pipe 24 at the grouting segment of the pile casing; platform 25 inside the pile casing; upper-end casing 26 of the pile casing; sleeve 3; temporary platform 31; steel pile 4; leveling supporting plate 41; jack 5; pile delivering pipe 6.

DETAILED DESCRIPTION

In order to make the purposes, technical solutions and advantages of the embodiments of the present disclosure more clear, the technical solutions provided in the embodiments of the present disclosure will be clearly and comprehensively described with reference to the figures for the embodiments of the present disclosure. Apparently, the embodiments described below are merely some, but not all of the embodiments of the present disclosure. All the other embodiments obtained by those ordinarily skilled in the art based on the embodiments provided in the present disclosure without using creative efforts shall fall within the scope of protection of the present disclosure. Hence, the following detailed description of the embodiments of the present disclosure provided in the figures is not intended to limit the scope of the disclosure as claimed, but merely shows the selected embodiments of the present disclosure. All the other embodiments, obtained by those ordinarily skilled in the art based on the embodiments provided in the present disclosure without using creative efforts, shall fall within the scope of protection of the present disclosure.

Embodiment 1

Figure 2:
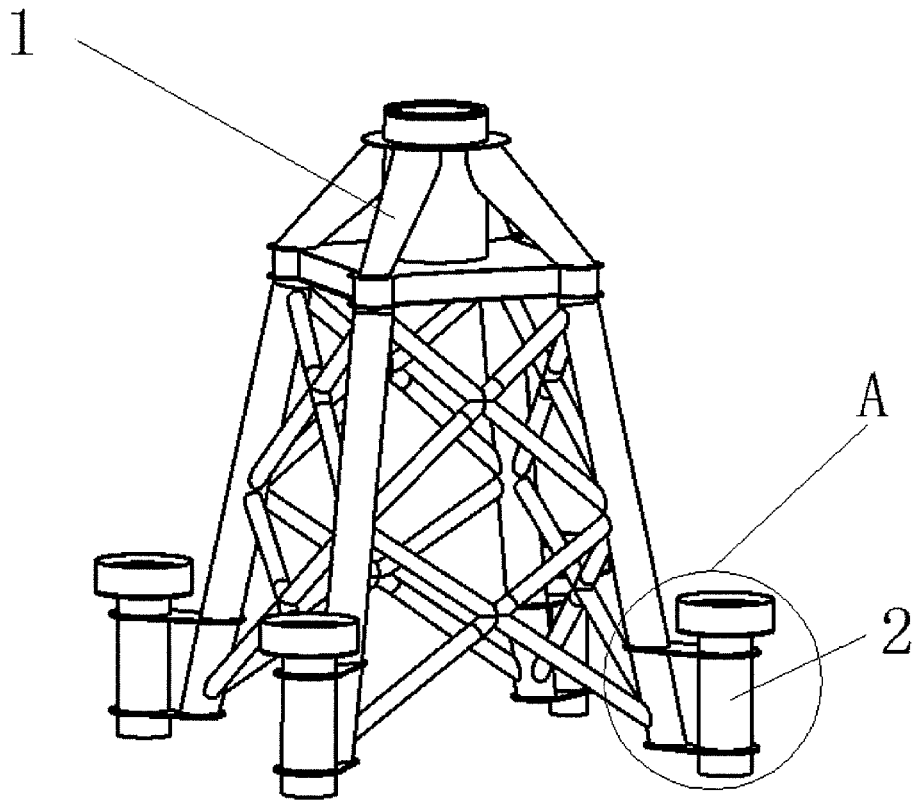
FIG. 2 is a structural schematic diagram of the device for constructing an offshore wind turbine foundation with piling performed afterwards provided by Embodiment 1 of the present disclosure, with sleeves removed.

Referring to FIG. 1 and FIG. 2, the device for constructing an offshore wind turbine foundation with piling performed afterwards provided by the present embodiment includes an offshore wind turbine foundation 1, pile casings 2 and sleeves 3. The pile casings 2 are each configured to install a steel pile 4. The pile casing 2 is provided at the bottom of the offshore wind turbine foundation 1. The lower end of each sleeve 3 is detachably connected with the upper end of one pile casing 2 through bolts.

In the present embodiment, the offshore wind turbine foundation 1 may be an offshore wind turbine jacket foundation, an offshore wind turbine three-pile foundation or multi-pile foundation, or the like.

Further, the pile casing 2 is in a prior structure, i.e. a structure which is connected with the offshore wind turbine foundation 1 and configured to pitch piles. And, the position where the pile casing 2 is provided at the offshore wind turbine foundation 1 belongs to the prior art. Normally, it is provided at the bottom of the offshore wind turbine foundation 1. The quantity of pile casings 2 is not specifically defined. There could be multiple pile casings. In the present embodiment, there are four pile casings 2.

In use, the device for constructing an offshore wind turbine foundation with piling performed afterwards provided by the present embodiment is implemented by first hoisting the sleeves 3 to the pile casings 2 of the offshore wind turbine foundation 1 and connecting the sleeves 3 with the pile casings 2, placing the offshore wind turbine foundation 1 with the sleeves 3 to the seabed in such a manner that the steel pipes at the lower ends of the pile casings 2 are placed on the seabed or inserted into the soil of the seabed, placing each steel pile 4 in one pile casing 2, driving the steel pile to the specified design elevation within the pile casing 2 by using a pile hammer, drawing out the seawater and silt, leveling the offshore wind turbine foundation 1, connecting the pile casings 2 with the steel piles 4 by welding and grouting which can be performed separately or simultaneously, and then removing the sleeves 3, thus completing the construction.

The device for constructing an offshore wind turbine foundation with piling performed afterwards provided by the present embodiment, by adding sleeves 3 for temporary work, ensures that leveling of the offshore wind turbine foundation 1 and connecting operation of the steel piles 4 with the offshore wind turbine foundation 1 require no underwater operations of persons, that is to say, dry construction is employed throughout the process, which is safe and reliable. By changing from wet construction to dry construction, the construction persons are allowed to perform monitoring in real time on the platform of the pile casing 2 and the construction accuracy is easy to control. Moreover, it is easy to embed piles into rocks in the dry construction. The sleeves 3 are temporary tools which may be removed and reused after the foundation construction is completed.

Based on the above technical solution of the device for constructing an offshore wind turbine foundation with filing performed later provided by the above embodiment, further: referring to FIG. 2 and FIG. 3, the pile casing 2 includes a vertical pipe 24 at the grouting segment of the pile casing, a platform 25 inside the pile casing and an upper-end casing 26 of the pile casing. The lower end of the upper-end casing 26 of the pile casing is connected with the upper end of the vertical pipe 24 at the grouting segment of the pile casing through the platform 25 inside the pile casing. The upper end of the upper-end casing 26 of the pile casing is detachably connected with the lower end of the sleeve 3. The platform 25 inside the pile casing is provided for facilitating grouting connection in dry construction.

Additionally, water is prevented from entering the bottom of the pile casing 2 mainly by the following two measures: a) a rubber water-sealing gasket is provided at the bottom of the inner wall of the pile casing 2 in advance, and thus water seal will be formed when the rubber water-sealing gasket is pressed after driving the steel pile 4; and b) the steel pipe at the bottom of the pile casing 2 is partially inserted into the soil of the seabed for preventing water from entering.

In the present embodiment, a rubber water-sealing gasket is provided at the lower end of the inner wall of the pile casing 2. As the rubber water-sealing gasket is provided at the lower end of the inner wall of the pile casing 2 in advance, water seal will be formed when the rubber water-sealing gasket is pressed after driving the steel pile 4.

Figure 3:
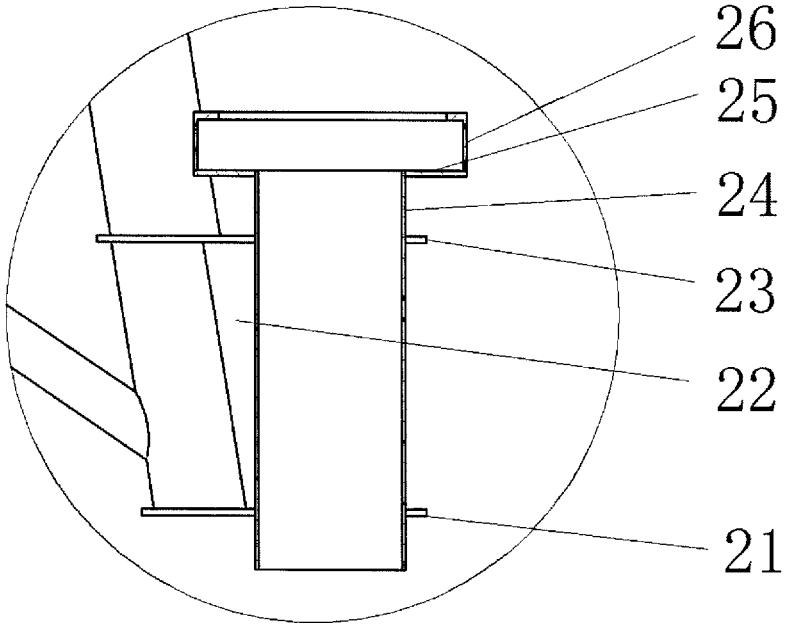
FIG. 3 is a partial enlarged view of the device for constructing an offshore wind turbine foundation with piling performed afterwards provided by Embodiment 1 of the present disclosure, at A in FIG. 2.

Referring to FIG. 3, the upper portion of the pile casing 2 is connected with the offshore wind turbine foundation 1 by a bottom connecting plate 21. The lower portion of the pile casing 2 is connected with the offshore wind turbine foundation 1 by a transverse connecting plate 23. The outer sidewall of the pile casing 2 is connected with the offshore wind turbine foundation 1 by a vertical connecting plate 22. The lower end of the pile casing 2 is flush with the bottom connecting plate 21 or protrudes from the bottom connecting plate 21.

With the bottom connecting plate 21, the transverse connecting plate 23 and the vertical connecting plate 22, the pile casing 2 can be fixedly connected with the offshore wind turbine foundation 1 very steadily. The lower end of the pile casing 2 is flush with the bottom connecting plate 21 or protrudes from the bottom connecting plate 21, wherein the protruded portion can be placed on the seabed or inserted into the sand layer of the seabed, so as to improve the sealing performance between the pile casing 2 and the sleeve 3.

Figure 4:
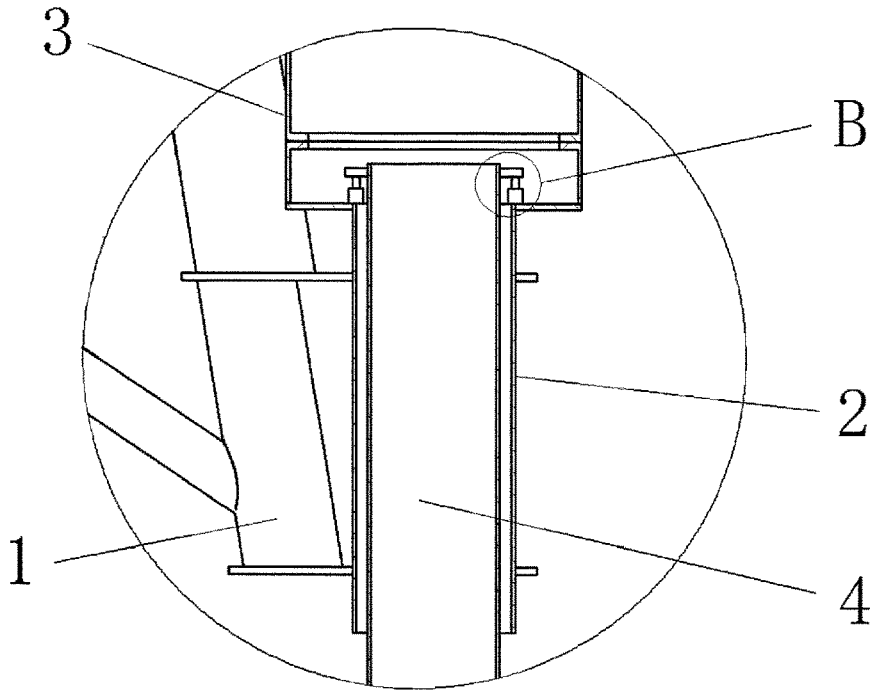
FIG. 4 is a structural schematic diagram showing connection between a sleeve and a pile casing of the device for constructing an offshore wind turbine foundation with piling performed afterwards provided by Embodiment 1 of the present disclosure.
Figure 5:
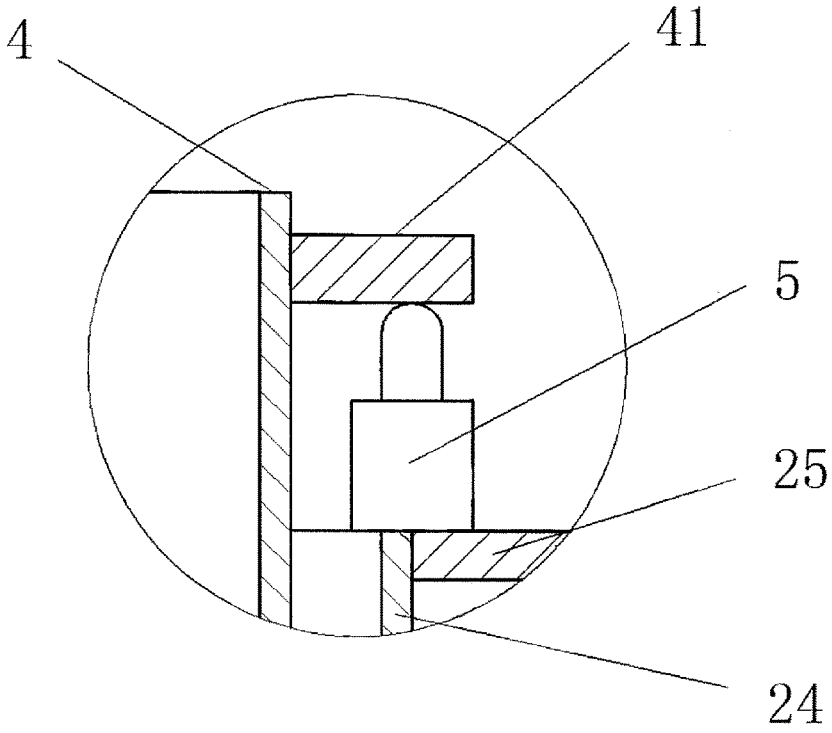
FIG. 5 is a partial enlarged view of the device for constructing an offshore wind turbine foundation with piling performed afterwards provided by Embodiment 1 of the present disclosure, at B in FIG. 4.

Additionally, referring to FIG. 4 and FIG. 5, the device for constructing an offshore wind turbine foundation with piling performed afterwards further includes leveling devices for leveling the offshore wind turbine foundation 1. The leveling device is provided within the pile casing 2. The leveling device includes a jack 5 and a leveling supporting plate 41. The leveling supporting plate 41 is provided at the top of the steel pile 4. The jack 5 is provided between the leveling supporting plate 41 and the platform 25 inside the pile casing.

The basic idea for leveling comprises: providing the jack 5 on the platform 25 inside the pile casing, and jacking the steel pile 4 to press down the offshore wind turbine foundation 1, for leveling. The steel pile 4 is welded at its top with the leveling supporting plate 41. The bottom of the jack 5 is placed on the vertical pipe 24 at the grouting segment of the pile casing and on the platform 25 inside the pile casing. The top of the jack 5 supports the steel pile 4 and the leveling supporting plate 41. After leveling, the pile casing 2 and the steel pile 4 may be connected by welding first and then grouting.

By providing the leveling device, it is convenient for the construction persons to perform leveling in dry construction, and ensures that leveling of the offshore wind turbine foundation 1 requires no underwater operation of persons, which is safe and reliable.

Referring to FIG. 1, the sleeve 3 in the present embodiment is provided at its upper end with a temporary platform 31. The temporary platform 31 is connected with the offshore wind turbine foundation 1. The temporary platform 31 serves as both a pedestrian passage between a platform of the offshore wind turbine foundation 1 and the sleeve 3, and a supporting structure for stabilizing the sleeve 3, and it can be used as a platform for placing devices for embedding piles into rocks or other construction devices.

In addition, in the present embodiment, a ladder stand may be provided in the sleeve 3 as required, for easy access of construction persons to the sleeve 3 to perform construction. As to the connection between the sleeve 3 and the offshore wind turbine foundation 1, a horizontal connection and an inclined support may also be added as required.

Once the offshore wind turbine foundation 1 is placed at the seabed, the steel pile 4 is pitched into the pile casing 2 and the steel pile 4 is driven by a pile delivering pipe 6 to a design elevation and adjacent to the upper end of the pile casing 2.

Referring to FIG. 1 to FIG. 5, the device for constructing an offshore wind turbine foundation with piling performed afterwards provided by the present embodiment has the following advantages.

(1) By adding sleeves 3 for temporary work, dry construction may be employed after water is drained through the sleeves 3, ensuring that leveling and grouting connection of the offshore wind turbine foundation 1 requires no underwater operations of persons, thus the dry construction is used throughout the process, which is safe and reliable.

(2) The traditional pile casing 2 is optimized and modified by designing steel pipes, which are located at lower ends and inserted into the soil for water sealing, and an upper-end structure which is connected with the sleeve 3.

(3) For connection between the upper end of the sleeve 3 and the platform of the offshore wind turbine foundation 1, a temporary platform 31 as a connecting structure is added, which serves as both the supporting structure and the passage and can be used as a platform for placing other construction devices.

(4) By changing from traditional wet grouting to dry grouting, the construction persons are allowed to performing monitoring in real time on the platform 25 inside the pile casing and the construction accuracy is easy to control.

(5) Grouting may be used and welding may be further used, for connection between the steel pile 4 and the pile casing 2, completely ensuring the strength and safety of the connection.

(6) The sleeve 3 and the water-sealing structure connected with the pile casing 2 significantly improve the water-sealing performance.

(7) The device can realize the operation of embedding piles into rocks in dry construction.

Embodiment 2

Referring to FIG. 1 to FIG. 5, the present embodiment provides a method for constructing an offshore wind turbine foundation with piling performed afterwards.

The method is applicable to the device for constructing an offshore wind turbine foundation with piling performed afterwards provided in Embodiment 1. The method includes: connecting sleeves 3 to the upper ends of the pile casings 2 before hoisting the offshore wind turbine foundation 1; placing the offshore wind turbine foundation 1 on the seabed in such a manner that the steel pipes at the bottoms of the pile casings 2 are placed on the seabed or inserted into the soil of the seabed; disposing each steel pile 4 inside one pile casing 2 and driving the steel pile by using a pile hammer to a specified design elevation within the pile casing 2; drawing out the seawater and silt within the sleeves 3 and the pile casings 2 after the piling procedure is completed; leveling the offshore wind turbine foundation 1; connecting the pile casings 2 with the steel piles 4 on site by welding and grouting which can be performed separately or simultaneously; and removing the sleeves 3.

Embodiment 3

Referring to FIG. 1 to FIG. 5, the present embodiment provides a method for constructing an offshore wind turbine foundation with piling performed afterwards. This construction method differs from that provided in Embodiment 2 in the following aspects.

The construction method provided by the present embodiment further includes a leveling method for leveling the offshore wind turbine foundation 1. The leveling method is applicable to a leveling device. The leveling device includes a jack 5 and a leveling supporting plate 41. The leveling supporting plate 41 is provided at the top of the steel pile 4. A platform 25 inside the pile casing is provided inside the pile casing 2. The jack 5 is provided between the leveling supporting plate 41 and the platform 25 inside the pile casing.

The leveling method includes the following steps.

The construction person goes down from the sleeve 3 to the platform 25 inside the pile casing. The construction person places the jack 5 between the leveling supporting plate 41 and the platform 25 inside the pile casing. The jack 5 abuts against the leveling supporting plate 41 to jack up the steel pile 4 so that the offshore wind turbine foundation 1 is pressed down, thus leveling, the offshore wind turbine foundation 1.

It is convenient for the construction persons to perform leveling in dry construction, and ensures that leveling of the offshore wind turbine foundation 1 requires no underwater operations, which is safe and reliable.

Embodiment 4

Referring to FIG. 1 to FIG. 5, the present embodiment provides a method for constructing an offshore wind turbine foundation with piling performed afterwards. The construction method is applicable to the device for constructing an offshore wind turbine foundation with piling performed afterwards provided in Embodiment 1. The construction method includes specifically the steps of: (1) fixing each rubber water-sealing gasket at the bottom of the pile casing 2 to the pile casing 2 after the processing of the offshore wind turbine foundation 1 is completed; (2) hoisting the sleeves 3 to the pile casings 2 of the offshore wind turbine foundation 1 and connecting them with bolts, before hoisting the offshore wind turbine foundation; (3) connecting the temporary platforms 31 on the sleeves 3 fixedly with the platform of the offshore wind turbine foundation 1 respectively; (4) placing the offshore wind turbine foundation 1 with the sleeves 3 on the seabed in such a manner that the steel pipes at the bottoms of the pile casings 2 are placed on the seabed or inserted into the soil of the seabed; (5) placing each steel pile 4 inside one pile casing 2; (6) driving each steel pile using a pile hammer, and connecting a pile delivering pipe 6 when the top of the steel pile 4 approaches the uppermost end of the offshore wind turbine foundation 1, further driving the steel pile until it achieves a specified design elevation within the pile casing 2, wherein when the piling is finished, if the steel pile 4 is driven to a bearing stratum due to design deviation such that the excess portion of the steel pile 4 fails to reach the design elevation, the pile may be cut; (7) drawing out the seawater and silt within the sleeves 3 and the pile casings 2 after the piling procedure is completed; (8) the construction person going down from the sleeve 3 to the platform 25 inside the pile casing; (9) the construction person placing the jack 5 between the leveling supporting 41, which is welded to the top of the steel pile 4, and the platform 25 inside the pile casing, to perform leveling operation on the offshore wind turbine foundation 1; (10) after the leveling, welding the pile ends of the steel piles 4 with the pile casings 2 as required, and then performing grouting to connect the pile casings 2 with the steel piles 4; (11) the construction person removing, after installation of the offshore wind turbine foundation 1 is completed, the bolts between the sleeves 3 and the pile casings 2 and the construction person climbing up the sleeve 3; (12) removing the sleeves 3; and (13) embedding the steel piles into the rocks, if necessary, as required by the actual situation and design requirements.

It should be appreciated that in the description of the present disclosure, orientation or positional relations indicated by terms such as "center", "longitudinal", "transverse", "length", "width", "thickness", "upper", "lower", "front", "back", "left", "right", "vertical", "horizontal", "top", "bottom", "inner", "outer", "clockwise" and "counterclockwise" are the orientation or positional relations shown based on the figures, only for facilitating and simplifying description of the present disclosure, rather than indicating or implying that the referred devices or elements must be in a particular orientation or constructed or operated in the particular orientation, and therefore they should not be construed as limiting the present disclosure.

In addition, terms such as "first" and "second" are only used for the purpose of description and cannot be interpreted as indicating or implying importance in relativity or implicitly showing the number of the technical features referred to. Hence, features defined with "first" and "second" can explicitly or implicitly include one or more of such features. In the description of the present disclosure, "plurality" means two or more, unless otherwise specifically defined.

It should also be noted that, in the present disclosure, terms such as "mount", "coupled", "connected" and "fixed" should be interpreted in a broad sense, unless otherwise explicitly specified and defined. For example, it may be fixed connection, detachable connection, or integrated connection, or it could be mechanical connection or electrical connection, or it could be direct connection or indirect connection via an intermediate medium, or it could be internal communication or interaction between two elements. Those ordinarily skilled in the art can understand the specific meanings of the above terms in the present disclosure according to specific circumstances.

In the present disclosure, the description that a first feature is "above" or "below" a second feature may indicate that the first feature and the second feature are in direct contact, or that the first feature and the second feature are not in direct contact, but rather contact by another feature therebetween. Further, the description that a first feature is "above", "over" and "on" a second feature indicates that the first feature is right above the second feature or is above but deviated from the central line of the second feature, or only that the first feature is located at a higher horizontal height than the second feature. Further, the description that a first feature is "below", "under" and "beneath" a second feature indicates that the first feature is right below the second feature or is below but deviated from the central line of the second feature, or only that the first feature is located at a lower horizontal height than the second feature.

The above description only shows preferable embodiments of the present disclosure and is not intended to limit the present disclosure. Various modifications and variations of the present disclosure will occur to those skilled in the art. Any modifications, equivalent replacements and improvements made within the spirit and principle of the present disclosure shall be encompassed by the scope of protection of the present disclosure.

The invention claimed is:

1. A device for constructing an offshore wind turbine foundation, comprising the offshore wind turbine foundation, pile casings and sleeves, wherein the pile casings are each configured to install a steel pile, the pile casings are provided at a bottom of the offshore wind turbine foundation, and a lower end of each sleeve is detachably connected with an upper end of one respective pile casing, wherein the piling is performed after the offshore wind turbine foundation is placed on seabed and each of the steel piles is placed inside one respective pile casing, each of the pile casings comprises a platform inside the each pile casing, the sleeves are each configured for allowing a construction person to go down from the platform inside the pile casing, so as to ensure that leveling of the offshore wind turbine foundation and connection of the steel piles with the offshore wind turbine foundation can be achieved through a dry operation;

the constructing device further comprises leveling devices configured for leveling the offshore wind turbine foundation, wherein the leveling devices are each provided within one respective pile casing; and each of the leveling devices comprises a jack and a leveling supporting plate, the leveling supporting plate is provided at a periphery of a top of one corresponding steel pile, and the jack is provided between the leveling supporting plate and the platform inside one corresponding pile casing.

2. The device for constructing an offshore wind turbine foundation with piling performed afterwards according to claim 1, wherein each of the pile casings further comprises a vertical pipe at a grouting segment of the each pile casing and an upper-end casing of the each pile casing, a lower end of the upper-end casing of the each pile casing is connected with an upper end of the vertical pipe at the grouting segment of the each pile casing through the platform inside the each pile casing, and an upper end of the upper-end casing of the each pile casing is detachably connected with a lower end of one respective sleeve.

3. The device for constructing an offshore wind turbine foundation with piling performed afterwards according to claim 1, wherein an upper portion of each of the pile casings is connected with the offshore wind turbine foundation by a bottom connecting plate, a lower portion of the each pile casing is connected with the offshore wind turbine foundation by a transverse connecting plate, and an outer sidewall of the each pile casing is connected with the offshore wind turbine foundation by a vertical connecting plate.

4. The device for constructing an offshore wind turbine foundation with piling performed afterwards according to claim 3, wherein a lower end of the each pile casing is flush with the bottom connecting plate or protrudes from the bottom connecting plate.

5. The device for constructing an offshore wind turbine foundation with piling performed afterwards according to claim 1, wherein an upper end of each of the sleeves is provided with a temporary platform, and the temporary platform is connected with the offshore wind turbine foundation.

6. A method for constructing an offshore wind turbine foundation, wherein the method is applicable to the device for constructing an offshore wind turbine foundation with piling performed afterwards according to claim 1, and the method comprises:

connecting each of the sleeves to the upper ends of the respective pile casing before hoisting the offshore wind turbine foundation;

placing the offshore wind turbine foundation on seabed in such a manner that steel pipes at bottoms of the pile casings are placed on the seabed or inserted into soil of the seabed;

placing each steel pile inside one respective pile casing and driving the each steel pile by using a pile hammer to a specified design elevation within the respective pile casing;

drawing out seawater and silt within the sleeves and the pile casings after pile-driving process is completed;

leveling the offshore wind turbine foundation;

connecting the pile casings with the steel piles on site by welding and grouting which can be performed separately or simultaneously; and removing the sleeves, each of the pile casings comprises a platform inside the each pile casing, the sleeves are each configured for allowing a construction person to go down from the platform inside the pile casing, so as to ensure that leveling of the offshore wind turbine foundation and connection of the steel piles with the offshore wind turbine foundation can be achieved through a dry operation;

the constructing device further comprises leveling devices configured for leveling the offshore wind turbine foundation, wherein the leveling devices are each provided within one respective pile casing; and each of the leveling devices comprises a jack and a leveling supporting plate, the leveling supporting plate is provided at a periphery of a top of one corresponding steel pile, and the jack is provided between the leveling supporting plate and the platform inside one corresponding pile casing.

7. The method for constructing an offshore wind turbine foundation with piling performed afterwards according to claim 6, further comprising a leveling method for leveling the offshore wind turbine foundation, wherein the leveling method is applicable to a leveling device, the leveling device comprises a jack and a leveling supporting plate, the leveling supporting plate is provided at a top of each steel pile, the each pile casing is provided therein with the platform inside the pile casing, and the jack is provided between the leveling supporting plate and the platform inside the pile casing; and the leveling method comprises:

placing, by a construction person on the platform inside the pile casing, the jack between the leveling supporting plate and the platform inside the pile casing, the jack abutting against the leveling supporting plate to jack up the steel pile so that the offshore wind turbine foundation is pressed down, thus leveling the offshore wind turbine foundation.

8. The method for constructing an offshore wind turbine foundation with piling performed afterwards according to claim 6, wherein each of the pile casings further comprises a vertical pipe at a grouting segment of the each pile casing and an upper-end casing of the each pile casing, a lower end of the upper-end casing of the each pile casing is connected with an upper end of the vertical pipe at the grouting segment of the each pile casing through the platform inside the each pile casing, and an upper end of the upper-end casing of the each pile casing is detachably connected with a lower end of one respective sleeve.

9. The method for constructing an offshore wind turbine foundation with piling performed afterwards according to claim 6, wherein an upper portion of each of the pile casings is connected with the offshore wind turbine foundation by a bottom connecting plate, a lower portion of the each pile casing is connected with the offshore wind turbine foundation by a transverse connecting plate, and an outer sidewall of the each pile casing is connected with the offshore wind turbine foundation by a vertical connecting plate.

10. The method for constructing an offshore wind turbine foundation with piling performed afterwards according to claim 9, wherein a lower end of the each pile casing is flush with the bottom connecting plate or protrudes from the bottom connecting plate.

11. The method for constructing an offshore wind turbine foundation with piling performed afterwards according to claim 6, wherein an upper end of each of the sleeves is provided with a temporary platform, and the temporary platform is connected with the offshore wind turbine foundation.

* * * * *